US011488535B2

(12) United States Patent
Hou

(10) Patent No.: US 11,488,535 B2
(45) Date of Patent: Nov. 1, 2022

(54) PIXEL DRIVING CIRCUIT, METHOD OF DRIVING SAME, AND DISPLAY PANEL

(71) Applicant: Wuhan China Star Optoelectronics Semiconductor Display Technology Co., Ltd., Hubei (CN)

(72) Inventor: Xueshun Hou, Hubei (CN)

(73) Assignee: Wuhan China Star Optoelectronics Semiconductor Display Technology Co., Ltd., Hubei (CN)

( * ) Notice: Subject to any disclaimer, the term of this patent is extended or adjusted under 35 U.S.C. 154(b) by 274 days.

(21) Appl. No.: 16/621,569

(22) PCT Filed: Jul. 3, 2019

(86) PCT No.: PCT/CN2019/094514

§ 371 (c)(1),
(2) Date: Dec. 11, 2019

(87) PCT Pub. No.: WO2020/199404

PCT Pub. Date: Oct. 8, 2020

(65) Prior Publication Data

US 2021/0358398 A1 Nov. 18, 2021

(30) Foreign Application Priority Data

Mar. 29, 2019 (CN) ..... 201910253240.5

(51) Int. Cl.
*G09G 3/325* (2016.01)

(52) U.S. Cl.
CPC ..... *G09G 3/325* (2013.01); *G09G 2300/043* (2013.01); *G09G 2300/0876* (2013.01); *G09G 2310/0278* (2013.01)

(58) Field of Classification Search
CPC ..... G09G 3/3225–3266
See application file for complete search history.

(56) References Cited

U.S. PATENT DOCUMENTS

2008/0291351 A1* 11/2008 Han ..... G09G 3/3225 349/48
2010/0033409 A1 2/2010 Park
(Continued)

FOREIGN PATENT DOCUMENTS

CN 101645234 A 2/2010
CN 103927979 A 7/2014
(Continued)

*Primary Examiner* — Hang Lin
(74) *Attorney, Agent, or Firm* — Taft Stettinius & Hollister LLP

(57) ABSTRACT

A pixel driving circuit, a method of driving the same, and a display panel are provided. The pixel driving circuit includes a scanning line, a data line, an organic light emitting diode, a first control switch, a second control switch, and a storage electric capacity. The scanning line drives a control end of the second control switch. An input end of the second control switch is connected to the data line. An output end of the second control switch drives a control end of the first control switch. A first power source signal drives an input end of the first control switch. The organic light emitting diode is coupled between an output end of the first control switch and a second power source signal. The storage electric capacity is coupled between a first reference signal and the control end of the first control switch.

5 Claims, 9 Drawing Sheets

(56) References Cited

U.S. PATENT DOCUMENTS

| | | | | |
|---|---|---|---|---|
| 2012/0235973 | A1* | 9/2012 | Yoo | G09G 3/3233 345/211 |
| 2014/0198067 | A1 | 7/2014 | Jeon | |
| 2016/0314746 | A1 | 10/2016 | Ho | |
| 2016/0343278 | A1* | 11/2016 | Tsujita | G09G 3/3233 |
| 2017/0309228 | A1 | 10/2017 | Matsueda et al. | |
| 2018/0212014 | A1* | 7/2018 | Choi | H01L 27/3276 |

FOREIGN PATENT DOCUMENTS

| | | | |
|---|---|---|---|
| CN | 106157882 | A | 11/2016 |
| CN | 107305763 | A | 10/2017 |
| CN | 108364575 | A | 8/2018 |

* cited by examiner

PIXEL DRIVING CIRCUIT, METHOD OF DRIVING SAME, AND DISPLAY PANEL

CROSS REFERENCE TO RELATED APPLICATIONS

This application claims priority to, and the benefit of, International Application No. PCT/CN2019/094514, filed on Jul. 3, 2019, which claims priority to, and the benefit of, Chinese Application No. 201910253240.5, filed on Mar. 29, 2019. The entire disclosures of each of the above applications are incorporated herein by reference.

FIELD OF INVENTION

The present disclosure relates to display technologies, and more particularly, to a pixel driving circuit, a method of driving the same, and a display panel.

BACKGROUND OF INVENTION

Organic light emitting display (OLED) panel, with many advantages such as self-illumination, low driving voltage, high luminous efficiency, short response time, high definition and contrast ratio, near 180° viewing angle, wide temperature range, flexible display, and large-area full-color display, is recognized by industry as a most promising display device.

In OLED displays, thin film transistors (TFTs) are often used in conjunction with capacitors to storage signals to control grayscale performance of the OLEDs. In order to achieve the purpose of constant current driving, each pixel needs to be composed of at least two TFTs and one storage capacitor, that is, 2T1C mode. Since a pixel driving circuit of the 2T1C structure does not have a function of compensating for a threshold voltage of a driving thin film transistor, display manufacturers propose a variety of pixel driving circuits capable of compensating for the threshold voltage of the driving thin film transistor.

However, such pixel driving circuit may cause an unstable illuminating current, resulting in crosstalk of a liquid crystal picture on a display panel.

Referring to FIG. 1, a basic driving circuit of AMOLEDs is the 2T1C structure, including two transistors T1 and T2, and a storage capacitor Cst. A driving current of the OLED is controlled by a driving transistor T2, and a current magnitude thereof is: $I=k(V_{gs}-V_{th})^2$, where k is a current amplification factor of the T2 transistor, and determined by the characteristics of the T2 transistor itself. Vth is the threshold voltage of the T2 transistor. The threshold voltage ($V_{th}$) of the T2 transistor is easily drifted to cause an OLED drive current fluctuate, and then to cause an OLED panel to be defective and to affect an image quality.

Therefore, prior art has drawbacks and is in urgent need of improvement.

SUMMARY OF INVENTION

In view of the above, the present disclosure provides a pixel driving circuit, a method of driving the same, and a display panel to solve a crosstalk of a liquid crystal picture on a display panel.

In order to achieve above-mentioned object of the present disclosure, one embodiment of the disclosure provides a pixel driving circuit including a scanning line, a data line, an organic light emitting diode, a first control switch, a second control switch, and a storage electric capacity. The scanning line drives a control end of the second control switch. An input end of the second control switch is connected to the data line. An output end of the second control switch drives a control end of the first control switch. A first power source signal drives an input end of the first control switch. An anode of the organic light emitting diode is couple to an output end of the first control switch. A cathode of the organic light emitting diode is couple to a second power source signal. The storage electric capacity is couple between a first reference signal and the control end of the first control switch. The first reference signal and the first power source signal are different.

In one selectable embodiment of the pixel driving circuit, the data line is partially overlap with a signal line of the first power source signal.

In one selectable embodiment of the pixel driving circuit, the pixel driving circuit is a circuit structure with 7 control switches and 1 storage electric capacity (7T1C). In detail, the pixel driving circuit further includes a third control switch, a fourth control switch, a fifth control switch, a sixth control switch, and a seventh control switch. A first end of the storage electric capacity is connected to the first reference signal, and a second end of the storage electric capacity is connected to the control end of the first control switch, an output end of the third control switch, and an output end of the fourth control switch. The input end of the first control switch is connected to the output end of the second control switch and an output end of the fifth control switch. The output end of the first control switch is connected to an input end of the third control switch, and an input end of the sixth control switch. The control end of the second control switch is connected to the scanning line. The input end of the second control switch is connected to the data line. A control end of the third control switch is connected to the scanning line. The input end of the third control switch is connected to the input end of the sixth control switch. A reset signal drives a control end of the fourth control switch and a control end of the seventh control switch. A second reference signal drives an input end of the fourth control switch and an input end of the seventh control switch. An enable signal drives a control end of the fifth control switch and a control end of the sixth control switch. The first power source signal drives an input end of the fifth control switch. An output end of the sixth control switch is connected to the anode of the organic light emitting diode and an output end of the seventh control switch. The cathode of the organic light emitting diode is connected to the second power source signal. A data signal of the data line drives the control end of the first control switch through the second control switch, the first control switch, and the third control switch when a scanning signal of the scanning line controls the second control switch and the third control switch to turn on.

In one selectable embodiment of the pixel driving circuit, the first reference signal and the second reference signal are at a low electrical level.

In one selectable embodiment of the pixel driving circuit, the first reference signal and the second reference signal are the same.

Furthermore, another embodiment of the disclosure provides a method of driving the aforementioned pixel driving circuit, including steps of:

controlling the pixel driving circuit to be in a data signal writing and threshold voltage compensating phase, wherein a data signal of the data line charges the storage electric capacity through the output end of the second control switch when a scanning signal of the scanning line controls the second control switch to turn on; and controlling the pixel driving circuit to be in a light emitting phase, wherein the storage electric capacity outputs voltage to the control end of the first control switch to keep the first control switch turning on to control the organic light emitting diode connected between the first power source signal and the second power source signal to emit light after the scanning signal of the scanning line controls the second control switch to turn off.

In one selectable embodiment of the method of driving the pixel driving circuit with the 7T1C circuit structure, the method of driving the pixel driving circuit further includes a step of controlling the pixel driving circuit to be in a reset phase that the reset signal drives the control end of the fourth control switch and the control end of the seventh control switch to turn on the fourth control switch and the seventh control switch, and the second reference signal drives the control end of the first control switch and the anode of the organic light emitting diode through the output end of the fourth control switch and the output end of the seventh control switch respectively before the step of controlling the pixel driving circuit to be in a data signal writing phase.

In one selectable embodiment of the method of driving the pixel driving circuit, the reset signal is at a low electric level, the scanning signal is at a high electric level and the reset signal is still at the low electric level when the scanning signal is turning to be the low electric level from the high electric level in the step of controlling the pixel driving circuit to be in the data signal writing and threshold voltage compensating phase.

In one selectable embodiment of the method of driving the pixel driving circuit, a voltage of the first power source signal ranges from 1V to 2V, a voltage of the first reference signal ranges from −3V to −2V, and a voltage of the data signal ranges from 2V to 6V.

Furthermore, another embodiment of the disclosure provides a display panel including the aforementioned pixel driving circuit.

In comparison with the prior art that a storage electric capacity is disposed between a first power source signal and a control end of a first control switch, one embodiment of the disclosure provides the storage electric capacity between the first reference signal and the control end of the first control switch, and provides the first reference signal independent and different from the first power source signal so that the storage electric capacity and the first power source signal are independent. An electrode layer of the storage electric capacity is insulating from a tracing line of the first power source signal in this disclosure to prevent from affect the first power source signal when the data signal is coupling to the first reference signal, and to reduce crosstalk.

DETAILED DESCRIPTION OF PREFERRED EMBODIMENTS

The following description of the embodiments is provided by reference to the following drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 1:
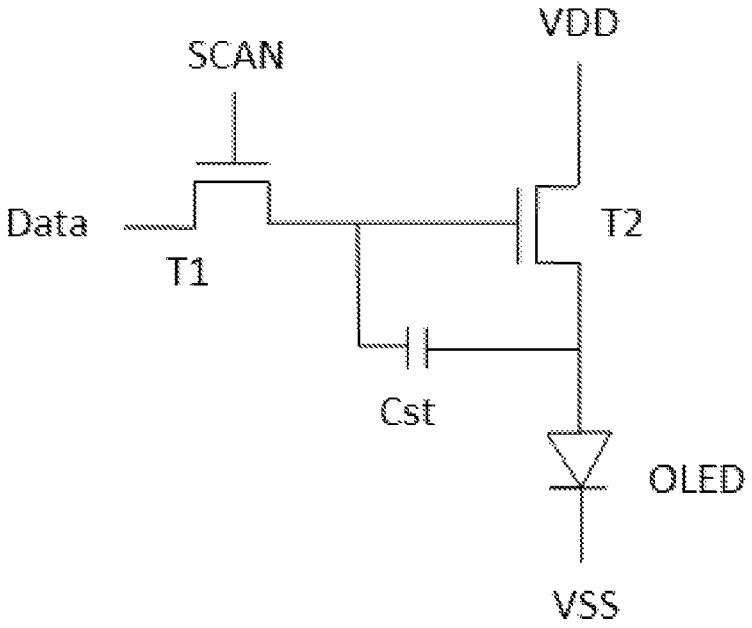
FIG. 1 is a schematic circuit of a pixel driving circuit of an active matrix organic light emitting diode (AMOLED) with 2T1C structure according to prior art.

Referring to FIG. 1, a basic driving circuit of an active matrix organic light emitting diode (AMOLED) is a 2T1C structure, including two transistors T1 and T2, and a storage electric capacity Cst. A driving current is control by the driving transistor T2. A magnitude of the driving current is $I=k(Vgs-Vth)^2$. k is a current amplification factor of transistor T2. k is determined by character of transistor T2. Vth is threshold voltage of transistor T2. The threshold voltage (Vth) of transistor T2 is easily shifting result in fluctuation of the driving current of OLEDs to affect a display quality of OLED panel.

Figure 2:
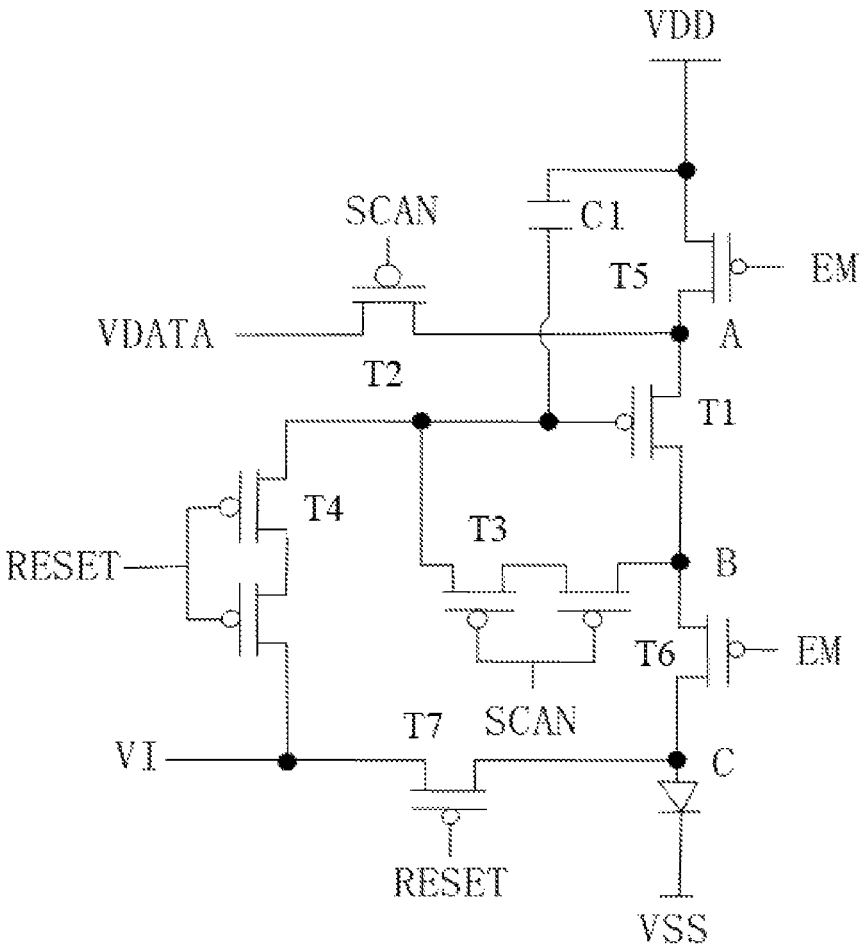
FIG. 2 is a schematic circuit of a pixel driving circuit of an AMOLED according to prior art.

Producers of displays provide some pixel driving circuits with threshold voltage compensation of driving transistors to solve traditional 2T1C AMOLED pixel driving circuits that have no function about compensation of threshold voltage of driving transistor. Referring to FIG. 2, FIG. 2 is a compensation circuit of pixels. A storage electric capacity C1 of the pixel circuit is connected between VDD and a gate of the driving transistor to hold a data message written in previous step in light emitting phase.

Figure 3:
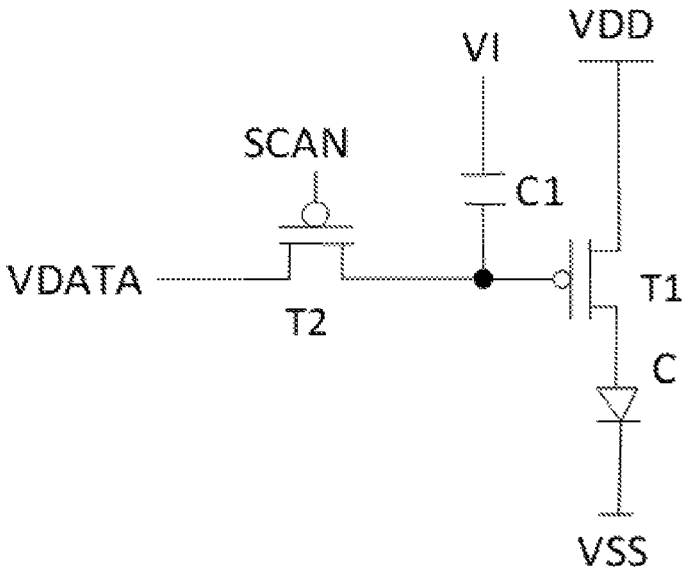
FIG. 3 is a schematic circuit of a pixel driving circuit according to an embodiment of the present disclosure.
Figure 4:
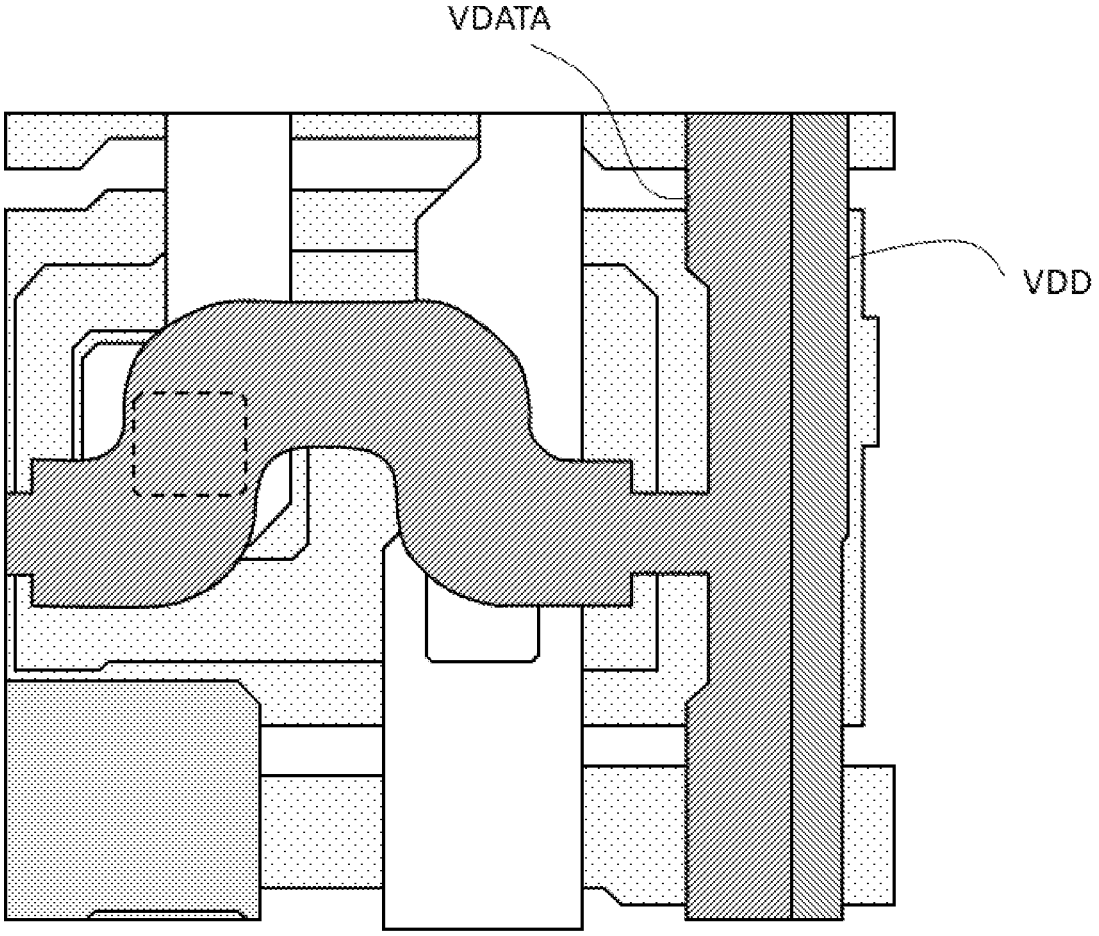
FIG. 4 is a schematic view of a structure of a pixel driving circuit of an AMOLED according to prior art.

Referring to FIG. 3 and FIG. 4, one embodiment of the disclosure provides a pixel driving circuit including a scanning line, a data line, an organic light emitting diode C, a first control switch T1, a second control switch T2, and a storage electric capacity C. The scanning line provides scanning signal SCAN to drives a control end of the second control switch T2. The data line provides data signal VDATA. An input end of the second control switch T2 is connected to the data signal VDATA. An output end of the second control switch T2 drives a control end of the first control switch T1. A first power source signal VDD drives an input end of the first control switch T1. The organic light emitting diode C is couple between an output end of the first control switch T1 and a second power source signal VSS. The storage electric capacity C1 is couple between a first reference signal VI and the control end of the first control switch T1. The first reference signal VI and the first power source signal VDD are different. The first control switch is a first transistor T1, and the second control switch is a second transistor T2.

In comparison with the prior art that a storage electric capacity is disposed between a first power source signal and a control end of a first control switch, one embodiment of the disclosure provides the storage electric capacity between the first reference signal and the control end of the first control switch, and provides the first reference signal independent and different from the first power source signal so that the storage electric capacity and the first power source signal are independent. Although voltage fluctuation of data line is larger, the storage electric capacity will not affect by the voltage fluctuation of the data line no matter the data line is overlap with the signal line received the first power source signal or not. Freedom of circuit design and area of circuit design is better when there is no need to consider the overlap of the data line and the signal line received the first power source signal.

In one selectable embodiment of the pixel driving circuit, the data line received the data signal VDATA is partially overlap with a signal line received the first power source signal VDD. Referring to FIG. 4, there is overlapping capacitance between the data signal VDATA and the first power source signal line VDD. The data signal is an oscillating signal when the display panel is working. An amplitude of the data signal is about 3V. the amplitude of the data signal will couple to the first power source signal to make the first power source signal fluctuate about a normal voltage. A light emitting current equation of the display panel is $I=k(VDD-VDATA)^2$. The fluctuation of the first power source signal will affect the light emitting current that's why a liquid crystal display crosstalk appear on the display panel. The storage electric capacity of the disclosure is independent from the first power source signal. An electrode layer of the storage electric capacity is insulated from the tracing line of the first power source signal to prevent from affect the first power source signal when the data signal is coupling to the first reference signal, and to reduce crosstalk.

In order to compensate the threshold voltage of the driving transistor, the pixel circuit can be one of 7T1C, 6T1C, 6T2C, 5T1C, and 4T1C.

Figure 5:
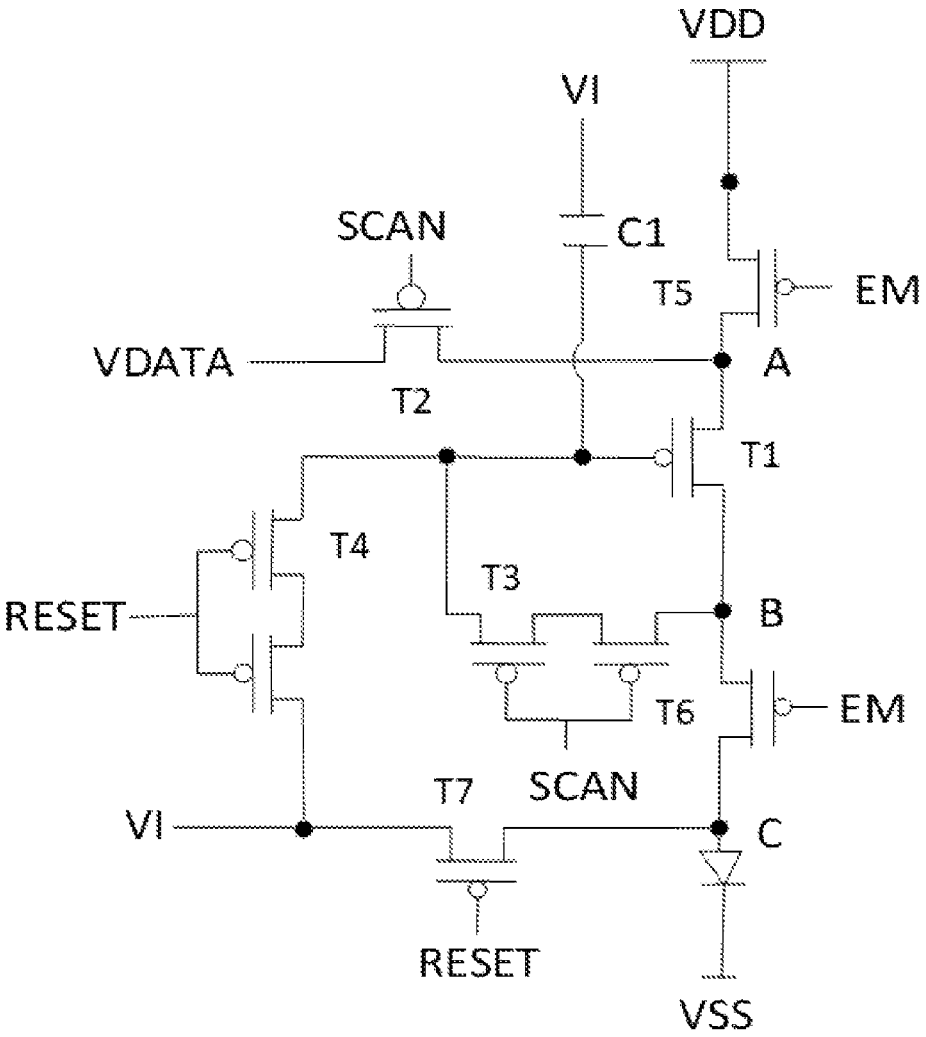
FIG. 5 is a schematic circuit of a pixel driving circuit with 7T1C structure according to an embodiment of the present disclosure.

Referring to FIG. 5, an example of one selectable embodiment of the pixel driving circuit is a pixel driving circuit with 7T1C circuit structure and transistors as control switches. In detail, the pixel driving circuit further includes a third transistor T3, a fourth transistor T4, a fifth transistor T5, a sixth transistor T6, and a seventh transistor T7. A first end of the storage electric capacity C1 is connected to the first reference signal VI, and a second end of the storage electric capacity C1 is connected to the control end of the first transistor T1, an output end of the third transistor T3, and an output end of the fourth transistor T4. The input end of the first transistor T1 is connected to the output end of the second transistor T2 and an output end of the fifth transistor T5. The output end of the first transistor T1 is connected to an input end of the third transistor T3, and an input end of the sixth transistor T6. The control end of the second transistor T2 is connected to the scanning signal SCAN. The input end of the second transistor T2 is connected to the data signal VDATA. A control end of the third transistor T3 is connected to the scanning signal SCAN. The input end of the third transistor T3 is connected to the input end of the sixth transistor T6. A reset signal RESET drives a control end of the fourth transistor T4. A second reference signal VI drives an input end of the fourth transistor T4 and an input end of the seventh transistor T7. An enable signal EM drives a control end of the fifth transistor T5. The first power source signal VDD drives an input end of the fifth transistor T5. An enable signal EM drives a control end of the sixth transistor T6. An output end of the sixth transistor T6 is connected to the anode of the organic light emitting diode and an output end of the seventh transistor T7. The reset signal RESET drives a control end of the seventh transistor T7. The cathode of the organic light emitting diode is connected to the second power source signal VSS. A data signal VDATA drives the control end of the first transistor T1 through the second transistor T2, the first transistor T1, and the third transistor T3 when a scanning signal SCAN controls the second transistor T2 and the third transistor T3 to turn on.

In detail, when the fourth transistor T4 and the seventh transistor T7 receive the reset signal RESET, the fourth transistor T4 and the seventh transistor T7 turn on and reset an electrical potential of the control end of the first transistor T1 and an electrical potential of the anode of the organic light emitting diode to a second reference signal VI.

When the control end of the second transistor T2 and the control end of the third transistor T3 receive the scanning signal, the second transistor T2 and the third transistor T3 turn on, the data signal transmits from output end of the second transistor T2 to point A, then transmits through the first transistor T1 to point B, and transmit through the third transistor T3 to the storage electric capacity C1.

The second transistor T2 and the third transistor T3 turn off. Voltage in storage electric capacity C1 output to the control end of the first transistor T1 to keep the first transistor T1 turning on. The fifth transistor T5 and the sixth transistor T6 receive enable signal EM, and the fifth transistor T5 and the sixth transistor T6 turn on. The organic light emitting diode is connected between the first power source signal VDD and the second power source signal VSS and is controlled to emit light.

In one selectable embodiment of the pixel driving circuit, the first reference signal VI and the second reference signal are at a low electrical level. In one selectable embodiment of the pixel driving circuit, the first reference signal VI and the second reference signal are the same.

Each transistor from the first transistor T1 to the seventh transistor T7 is P type transistor. Transistors from the first transistor T1 to the seventh transistor T7 is P type transistor are selected from low temperature polysilicon transistor, oxide semiconductor transistor, and amorphous silicon transistor.

The output end or the input end of each transistor from the first transistor T1 to the seventh transistor T7 is a source electrode or a drain electrode. The output end and the input end of each transistor from the first transistor T1 to the seventh transistor T7 are different electrode, for example, when the input end is a drain electrode, the output end is a source electrode, and when the input end is a source electrode, then the output end is a drain electrode.

Referring from FIG. 5 to FIG. 8, furthermore, another embodiment of the disclosure provides a method of driving the pixel driving circuit, including steps of:

Step S1: controlling the pixel driving circuit to be in a data signal writing and threshold voltage compensating phase.

Wherein a data signal VDATA charges the storage electric capacity C1 through the output end of the second transistor T2 when a scanning signal SCAN controls the second transistor T2 to turn on; and Step S2: controlling the pixel driving circuit to be in a light emitting phase.

Wherein the scanning signal SCAN controls the second transistor T2 to turn off, the storage electric capacity C1 outputs voltage to the control end of the first transistor T1 to keep the first transistor T1 turning on, and the organic light emitting diode connected between the first power source signal VDD and the second power source signal VSS emits light.

Referring to FIG. 5, in one selectable embodiment of the method of driving the pixel driving circuit with the 7T1C circuit structure, the method of driving the pixel driving circuit before data signal writing phase further includes a step of:

Step S0: controlling the pixel driving circuit to be in a reset phase.

The reset signal RESET drives the control end of the fourth transistor T4 and the control end of the seventh transistor T7 to turn on the fourth transistor T4 and the seventh transistor T7, and the second reference signal VI drives the control end of the first transistor T1 and the anode of the organic light emitting diode through the output end of the fourth transistor T4 and the output end of the seventh transistor T7 respectively.

Figure 6:
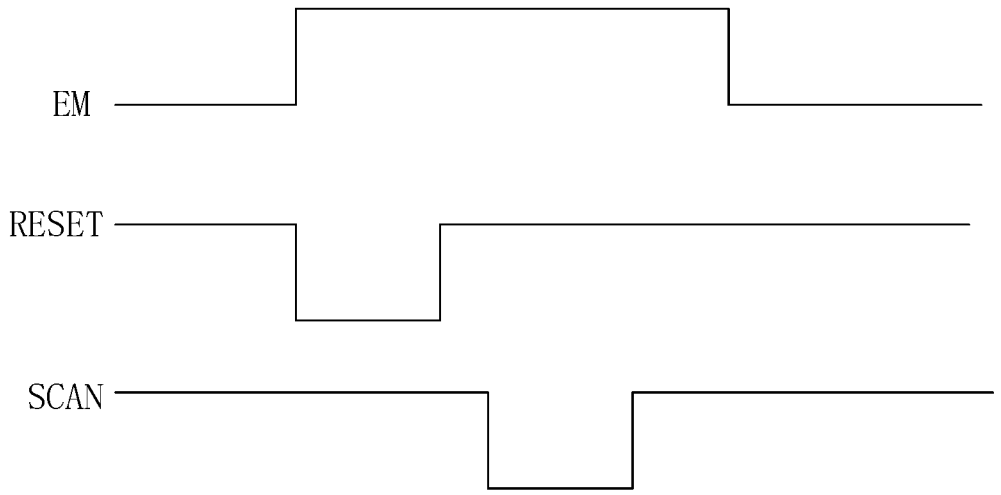
FIG. 6 is a signal timing schematic diagram of a pixel driving circuit according to an embodiment of the present disclosure.
Figure 7:
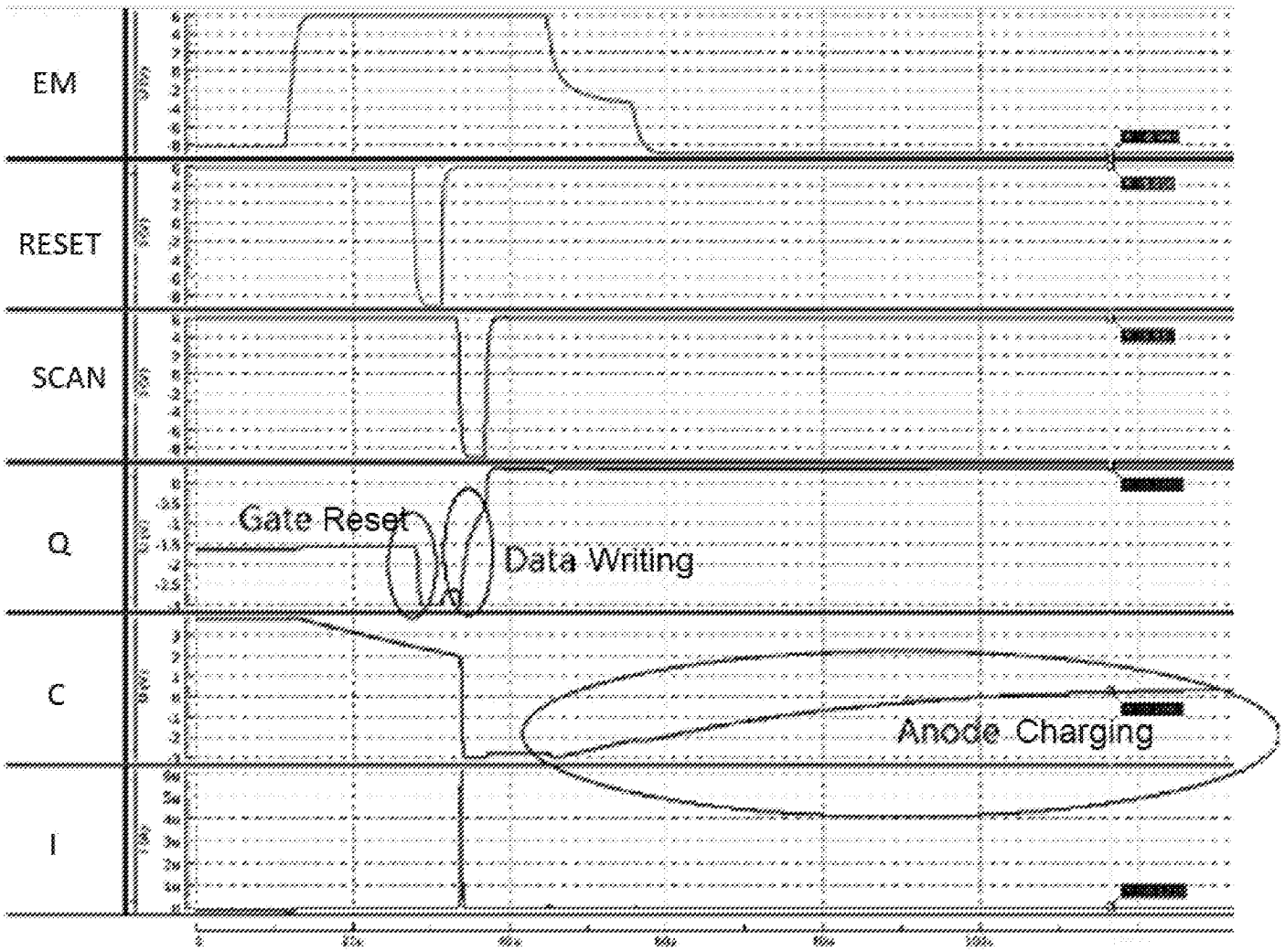
FIG. 7 is a signal timing simulation diagram of a pixel driving circuit according to an embodiment of the present disclosure.
Figure 8:
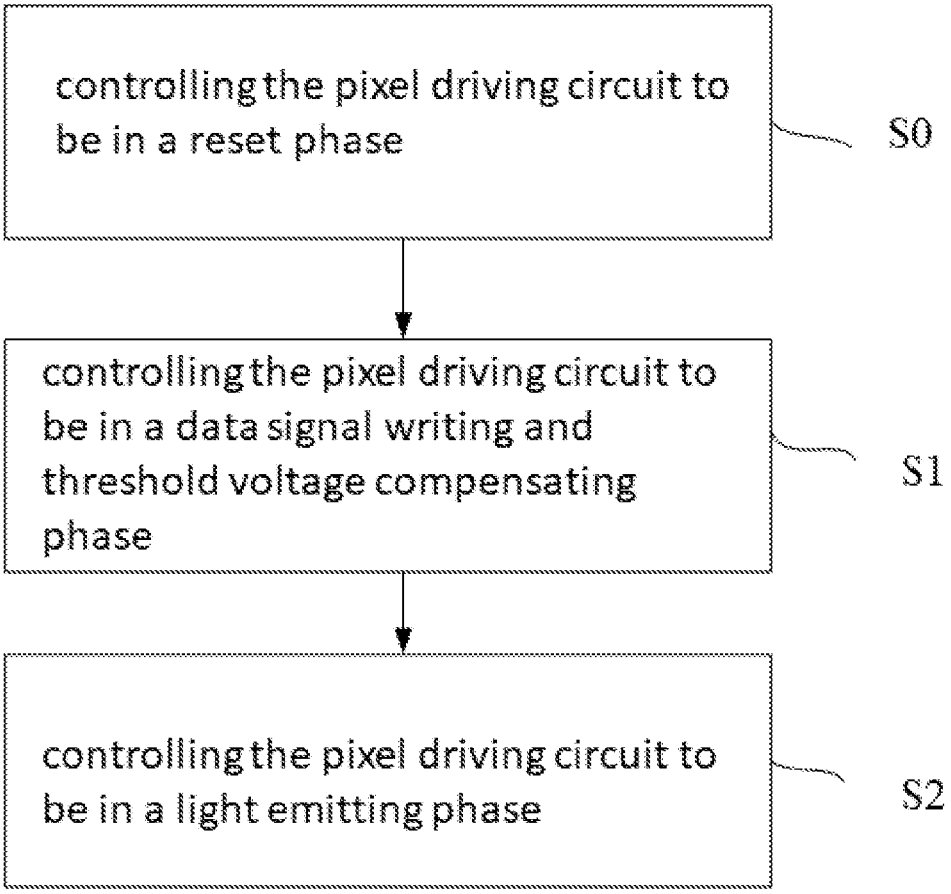
FIG. 8 is a schematic flowchart of a method of driving a pixel driving circuit according to an embodiment of the present disclosure.

Referring to FIG. 6, in detail, the enable signal EM is set at a high electric level and the reset signal RESET is set at a low electric level in the reset phase of Step S0. The fourth transistor T4 is turned on to reset the control end of the first transistor T1 to the second reference signal VI. The seventh transistor T7 is turned on to reset the anode of the organic light emitting diode to the second reference signal VI. The second reference signal VI is at low voltage, and the scanning signal is set to at a high electric level. In the embodiment, the enable signal EM and the reset signal RESET are turned on simultaneously (the enable signal EM is turned on first, and then the reset signal RESET is turned on). Referring to FIG. 7, the reset signal RESET can turn on after the turning on of the enable signal EM.

In the reset phase, the first transistor T1, the second transistor T2, the third transistor T3, the fifth transistor T5, and the sixth transistor T6 are turned off.

In detail, in the step S1 that controlling the pixel driving circuit to be in the data signal writing and threshold voltage compensating phase, the enable signal EM is keeping at a high electric level, and the reset signal RESET is set to at a high electric level. The second transistor T2 and the third transistor T3 is turned on. The data signal is transmitted through the second transistor T2, the first transistor T1, and the third transistor T3 consequently to the storage electric capacity C1, which is also the control end of the first transistor T1. Finally, the electrical potential of the control end of the first transistor T1 is V=VDATA+Vth, wherein the Vth is a threshold voltage of T1. The scanning signal is set at a low electric level in a first predetermined time, and set to translate from the low electric level to a high electric level at the end of the first predetermined time.

The fourth transistor T4, the fifth transistor T5, the sixth transistor T6, and the seventh transistor T7 is turned off.

In one selectable embodiment of the method of driving the pixel driving circuit, a voltage of the first power source signal VDD ranges from 1V to 2V, a voltage of the scanning signal ranges from −3V to −2V, and a voltage of the data signal ranges from 2V to 6V. The reset signal is still at the low electric level when the scanning signal is turning to be the low electric level from the high electric level to prevent from the electrical potential coupling of the control end of the first transistor T1 too high to affect sampling of the threshold voltage in the data signal writing phase.

In detail, in the Step S2 that controlling the pixel driving circuit to be in a light emitting phase, the enable signal EM is set at a low electric level. The fifth transistor T5 is turned on and the first power source signal VDD is provided to point A that the electric potential of point A is VA=VDD. The electric potential of the storage electric capacity C1 is provided to the control end of the first transistor T1. The electric potential of the control end of the first transistor T1 is V=VDATA+Vth. The sixth transistor T6 is turned on to let the driving current transmitted from the output end of the first transistor T1 through the sixth transistor T6 to the organic light emitting diode to drive the organic light emitting diode to emit light. At the same time, the reset signal RESET is keeping high electrical level, and the scanning signal is set at high electric level.

A light emitting current equation of the display panel is $I=k(VDD-VDATA)^2$, wherein I is the driving current, k is a current amplification factor of the T1 transistor, and determined by the characteristics of the T1 transistor itself. Vgs is the electrical potential of the control end of the first transistor T1, Vth is the threshold voltage, VDD is voltage of the first power source signal, and VDATA is voltage of the data signal.

The second transistor T2, the third transistor T3, the fourth transistor T4 and the seventh transistor T7 are turned off in the light emitting phase.

Referring to FIG. 7, the voltage of the anode (voltage of point C) is steady increasing even if the voltage of the storage electric capacity and the first reference signal VI fluctuates in the data signal writing phase (area b) after the gate signal is reset (area a) and the current I has a remarkable increase in light emitting phase to realize steady light emitting. The technical solution of the disclosure resolved the issue that the threshold voltage of the first transistor T1 is easily drifted to affect an image quality and the issue that a liquid crystal image crosstalk by the first power source signal coupled with the data signal.

Figure 9:
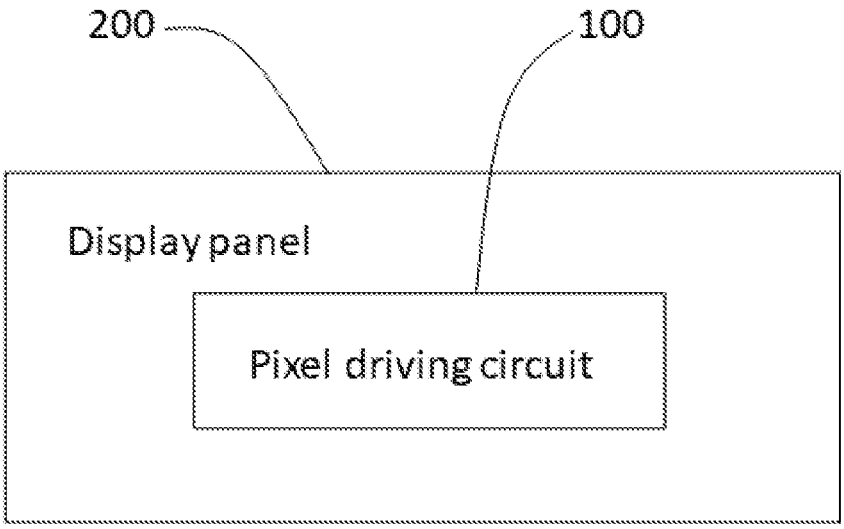
FIG. 9 is a schematic view of a structure of a display panel according to an embodiment of the present disclosure.

Furthermore, referring to FIG. 9, another embodiment of the disclosure provides a display panel including the aforementioned pixel driving circuit.

The technical solution of the disclosure is suitable for any kinds of display panel wildly, such as organic light emitting diode display panel.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A method of driving a pixel driving circuit, wherein the pixel driving circuit comprises: a scanning line, a data line, an organic light emitting diode, a first control switch, a second control switch, and a storage electric capacity;

wherein the scanning line drives a control end of the second control switch, an input end of the second control switch is connected to the data line, and an output end of the second control switch drives a control end of the first control switch;

wherein a first power source signal drives an input end of the first control switch, an anode of the organic light emitting diode is couple to an output end of the first control switch, and a cathode of the organic light emitting diode is couple to a second power source signal;

wherein the storage electric capacity is couple between a first reference signal and the control end of the first control switch, and the first reference signal and the first power source signal are different;

wherein the pixel driving circuit further comprises a third control switch, a fourth control switch, a fifth control switch, a sixth control switch, and a seventh control switch;

wherein a first end of the storage electric capacity is connected to the first reference signal, and a second end of the storage electric capacity is connected to the control end of the first control switch, an output end of the third control switch, and an output end of the fourth control switch;

wherein the input end of the first control switch is connected to the output end of the second control switch and an output end of the fifth control switch, and the output end of the first control switch is connected to an input end of the third control switch, and an input end of the sixth control switch;

wherein the control end of the second control switch is connected to the scanning line;

wherein a control end of the third control switch is connected to the scanning line, and the input end of the third control switch is connected to the input end of the sixth control switch;

wherein a reset signal drives a control end of the fourth control switch and a control end of the seventh control switch, and a second reference signal drives an input end of the fourth control switch and an input end of the seventh control switch;

wherein an enable signal drives a control end of the fifth control switch and a control end of the sixth control switch, and the first power source signal drives an input end of the fifth control switch;

wherein an output end of the sixth control switch is connected to the anode of the organic light emitting diode and an output end of the seventh control switch;

wherein the method comprises steps of:

controlling the pixel driving circuit to be in a reset phase that the reset signal drives the control end of the fourth control switch and the control end of the seventh control switch to turn on the fourth control switch and the seventh control switch, and the second reference signal drives the control end of the first control switch and the anode of the organic light emitting diode through the output end of the fourth control switch and the output end of the seventh control switch respectively;

controlling the pixel driving circuit to be in a data signal writing and threshold voltage compensating phase, wherein a data signal of the data line charges the storage electric capacity through the output end of the second control switch and drives the control end of the first control switch through the second control switch, the first control switch, and the third control switch, when a scanning signal of the scanning line controls the second control switch and the third control switch to turn on; and controlling the pixel driving circuit to be in a light emitting phase, wherein the storage electric capacity outputs voltage to the control end of the first control switch to keep the first control switch turning on to control the organic light emitting diode connected between the first power source signal and the second power source signal to emit light after the scanning signal of the scanning line controls the second control switch to turn off, and wherein the reset signal is at a low electric level, the scanning signal is at a high electric level and the reset signal is still at the low electric level when the scanning signal is turning to be the low electric level from the high electric level in the step of controlling the pixel driving circuit to be in the data signal writing and threshold voltage compensating phase.

2. The method of driving the pixel driving circuit according to claim 1, wherein a voltage of the first power source signal ranges from 1V to 2V, a voltage of the first reference signal ranges from −3V to −2V, and a voltage of the data signal ranges from 2V to 6V.

3. The method of driving the pixel driving circuit according to claim 1, wherein the data line is partially overlap with a signal line of the first power source signal.

4. The method of driving the pixel driving circuit according to claim 1, wherein the first reference signal and the second reference signal are at a low electrical level.

5. The method of driving the pixel driving circuit according to claim 1, wherein the first reference signal and the second reference signal are the same.

* * * * *